United States Patent [19]

Young

[11] Patent Number: 4,785,909

[45] Date of Patent: Nov. 22, 1988

[54] NOISE SILENCING SYSTEMS

[76] Inventor: Robert E. Young, 12 Whitnash Road, Leamington Spa, Warwickshire CV31 2HN, England

[21] Appl. No.: 805,468

[22] PCT Filed: Apr. 2, 1985

[86] PCT No.: PCT/GB85/00139

§ 371 Date: Dec. 3, 1985

§ 102(e) Date: Dec. 3, 1985

[87] PCT Pub. No.: WO85/04688

PCT Pub. Date: Oct. 24, 1985

[30] Foreign Application Priority Data

Apr. 14, 1984 [GB] United Kingdom ..... 8409744

[51] Int. Cl.[4] ..... F01N 1/10

[52] U.S. Cl. ..... 181/252; 181/249; 181/255; 181/258

[58] Field of Search ..... 181/240, 252, 255, 256, 181/258, 249, 233

[56] References Cited

U.S. PATENT DOCUMENTS

| | | | |
|---|---|---|---|
| 3,960,239 | 1/1976 | Frochaux et al. | 181/258 |
| 4,109,754 | 8/1978 | Purhoen | 181/252 |
| 4,314,621 | 2/1982 | Hansen | 181/233 |
| 4,346,781 | 8/1982 | Ingard et al. | 181/252 X |
| 4,487,290 | 12/1984 | Flaherty | 181/256 |
| 4,530,417 | 7/1985 | Daniel | 181/252 X |

FOREIGN PATENT DOCUMENTS

| | | |
|---|---|---|
| 802204 | 2/1951 | Fed. Rep. of Germany . |
| 976032 | 1/1963 | Fed. Rep. of Germany . |
| 1576765 | 4/1970 | Fed. Rep. of Germany . |
| 3149632 | 7/1983 | Fed. Rep. of Germany . |
| 1055010 | 2/1954 | France . |
| 1006477 | 4/1954 | France . |
| 2367187 | 5/1978 | France . |
| 481480 | 3/1938 | United Kingdom . |
| 968347 | 9/1964 | United Kingdom . |
| 1060334 | 10/1965 | United Kingdom . |

*Primary Examiner*—Benjamin R. Fuller

[57] ABSTRACT

A silencer device having a substantially aperiodic (non-frequency-dependent) silencing action is provided. The silencer is of the flow type comprising an elongate chamber generally defining or surrounding an unobstructed fluid transmission path. The chamber is principally occupied by fluid having a predetermined characteristic impedance and is provided at both ends with acoustic energy absorbing means for providing acoustic impedance type terminations to said chamber, the acoustic impedance of the terminations being substantially equal to the characteristic impedance of the fluid in the chamber.

18 Claims, 1 Drawing Sheet

NOISE SILENCING SYSTEMS

This invention relates to noise silencing systems for silencing noise developed in a fluid. The fluid may be a gas as in the case of the exhaust of a jet engine or a liquid in the case of a hydraulic power transmission system.

In the main existing silencers have fallen into two categories, namely the filter type and the shunt chamber type. The filter type generally comprise mechanical filter sections formed by dividing up some kind of cylindrical enlargement of the transmission pipe by means of transverse baffles incorporating restriction pipes. For example a pi-type filter may be formed by placing a baffle roughly midway along the cylindrical enlargement. Such a filter must be made part of the main transmission path and represents a substantial insertion loss. Additionally, the attenuation/frequency characteristic consists of a number of narrow frequency-band lobes with which are associated variations of impedance with frequency, which may theoretically be met by using a suitably designed series of filters. Generally the filter type silencer is regarded as being effective only at low frequencies, a typical upper limit being 300 cycles/-second.

Figure 1:
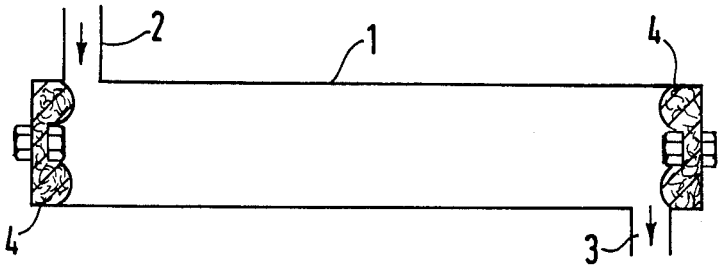

The shunt chamber type of silencer, as the name implies, comprises a chamber which generally surrounds a through-going transmission path and the present invention is directed towards this type of silencer. The chamber may have a dividing diaphragm separating the chamber from the transmission path, so that a different fluid may be used in the chamber but where the same fluid is used no separating diaphragm is necessary, as shown in FIG. 1, and where the paths of entry to, and exit from, the chamber are substantially perpendicular to the transmission path. The type of silencer where the duct is lined with a sound absorbent material is also placed in the shunt chamber category, the construction often comprising a chamber completely filled with, for example, glass fibre as the acoustic absorbent, the transmission pipe being coupled to the glass fibre in the chamber through a series of holes usually covered with a diaphragm-like fine wire mesh or glass fibre cloth. Known shunt type silencers are more effective at higher frequencies and the noise attenuation they provide is not great. Where it is desired to provide attenuation over a wide band of noise frequencies installations often consist of a combination of filter type and shunt chamber type silencers.

An object of the present invention is to provide an improved silencer of the shunt chamber type.

According to the invention, there is provided a silencer of the shunt chamber type wherein the chamber volume is principally occupied by a fluid but includes energy absorbing means, the chamber being so shaped as to provide good acoustic coupling with the transmission path and the energy absorbing means forming a characteristic impedance type termination.

The chamber may be separated from the transmission path by a diaphragm where the fluid in the chamber is different from the transmission fluid but of course this is not necessary if the two fluids are the same.

Preferably the fluid in the chamber is a gas because of its low density which gives a low characteristic impedance in the chamber, air being the most convenient gas since more data is available on the characteristics and behaviour of air. Additionally air leads to ease of topping-up and is relatively safe in leakage conditions.

Preferably the energy absorbent material comprises a metallic filament which is knitted, woven or crumpled together to form a pad or the like. Such material has high sound absorption properties which appear to be due to mutual chafing of the filaments within the pad, such energy absorption being largely aperiodic. A metallic pan-scrubber is such a material and although the term "pan-scrubber" is used hereinafter it is intended to cover other like material such as that available under the trade name "Vibrashock" which consists of very fine stainless steel wire knitted into open meshed sleeve form, which is crimped and then compacted to give a suitable characteristic for shock-mounting purposes. An alternative form of energy absorbing means comprises a screen-folded metallic gauze or mesh.

The energy absorbing means may include a taper to the end of the chamber. Preferably a one-way taper is used. Conveniently a relatively small annulus of "pan-scrubber" type material may be inserted at the end of the taper section. Other additional means include small corrugations and deliberate rough finishing of internal surfaces to give a combination of break-up and lossy actions on the sound pattern.

The silencer arrangements in accordance with the invention are largely aperiodic but where there is a predominant frequency band, the chamber may be broadly tuned to this frequency band to enable high coupling of the chamber to the transmission path.

In many respects the thoughts in connection with the present invention have been along the lines of developing an analogy between sound absorption and electrical energy absorption techniques in transmission line and waveguide. The analogy can only be pursued to a schematic level but the main concern is to provide the equivalent of a resistive load for terminating the chamber of absorbing the noise energy transferred to it. Ideally the value of the load thus presented should be the characteristic impedance of the chamber so as to be largely aperiodic.

In a silencer for fitting to the pipe run of a particular hydraulic power system without disturbing its cross-section, an annular shunt chamber has an inside diameter of some 2–3 times that of the transmission pipe, and with air filling is not less than about 6 cm. Length between termination material would be not less than 25 cm for air filling.

A sealing membrane covers coupling holes between the transmission and the shunt chamber. The diameter of the coupling holes into the shunt chamber are between 0.5 cm and 1 cm, and lie on circumference planes (perpendicular to the cylinder axis) with a corresponding pitch of 2.5 to 5 cm.

In the case of a jet engine a large shunt chamber silencer in accordance with the invention may be arranged about the jet efflux. However it may be more convenient to have a plurality of such silencer units arranged to take advantage of, but add to, the already known silencing arrangements. For example, an arrangement similar in some respects to UK Pat. No. 935,119 may be used but whereas groups of resonant chambers of graded size, each group designed to attenuate the narrow band of frequencies fixed by their dimensions as resonant cavities, are provided by the arrangement of the aforesaid patent, the arrangement according to the present invention requires fewer shunt chambers owing to their largely aperiodic nature.

Figure 2:
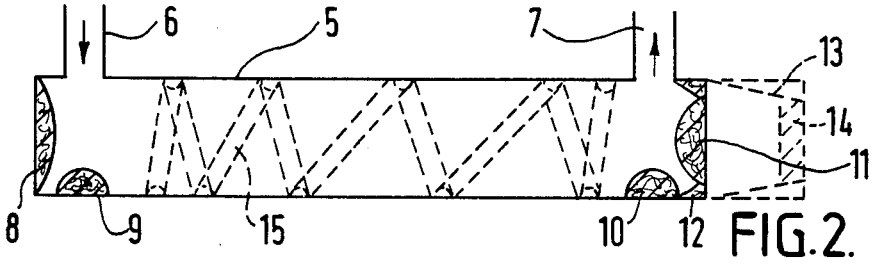
Figure 3:
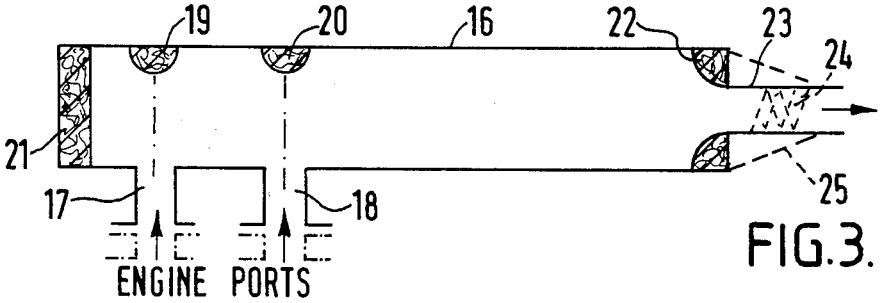
Figure 4:
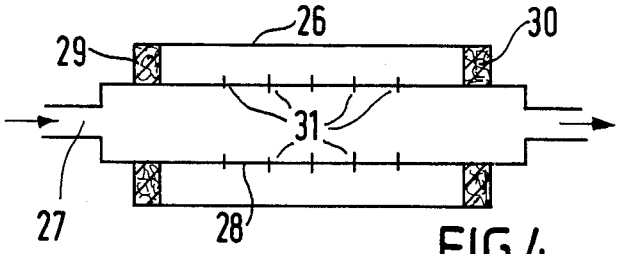
Figure 5:
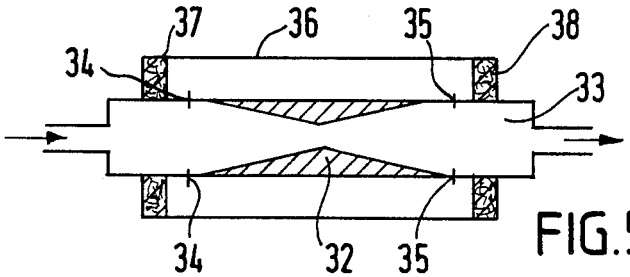

Embodiments of the invention will now be described with reference to the accompanying drawings, in which:

FIG. 1 is a sectional view of a simple form of silencer in accordance with the invention; for use with an internal combustion engine, FIG. 2 is a sectional view of a modified form of that shown in FIG. 1, FIG. 3 is a sectional view of a combined exhaust manifold and silencer in accordance with the invention, FIG. 4 is a sectional view of another silencer in accordance with the invention, and FIG. 5 is a sectional view of a modified form of the silencer shown in FIG. 4.

In the embodiment shown in FIG. 1, a silencer for a two stroke internal combustion engine comprises a shunt chamber 1 of cylindrical form which is fed via inlet 2 at right angles to the cylindrical axis adjacent one end and the outlet 3 is similarly at right angles but adjacent the other end. "Pan-scrubber" pads 4 are bolted down symmetrically at each end of the cylinder and bent over within it to give an increased probability of chafing, thus presenting convoluted dome profiles to the interior of the cylinder. These dome profiles protrude slightly into the cylindrical gas streams adjacent the input and output pipes (2, 3) and thus provide some absorbent break-up and impedance matching at these points. In this arrangement no separating diaphragm between the shunt chamber and the transmission path is required since the fluid in the chamber and in the path are the same.

In the modified form of silencer shown in FIG. 2, the energy absorbing material is bonded to the inner walls of the silencer tube 5 which has an inlet 6 and an outlet 7 both extending from the same side but towards opposite sides. At the inlet end there is a terminating pad 8 and a facing pad 9 of energy absorbing material. At the outlet end a similar facing pad 10 is provided and the terminating pad comprises a central pad 11 with a taper annulus 12 round it. As an alternative the chamber 5 may be terminated with a taper 13 and pad 14, as shown in broken line. Within the chamber there may be provided a helix 15 of progressively increasing pitch formed from D-section wire to provide break-up and loss action as the gases pass through the chamber.

The embodiment shown in FIG. 3 is a combined silencer and exhaust manifold for an internal combustion engine. Each engine port of which two are shown is coupled to the silencing chamber 16 by its own inlet (17, 18) and opposite each is a facing pad (19, 20) of energy absorbing material. These facing pads may be dome-like as shown or they may be annular with apertures therein corresponding with the respective inlets. The inlet end of the chamber is terminated with a pad 21.

At the right-hand end a terminating annulus 22 of energy absorbing material surrounds the outlet 23 from the chamber. A helix 24 may be placed in the outlet pipe and raised formations helical or other corrugations may be incorporated in the chamber 16. As an alternative the right hand end of the chamber may be tapered, as shown in broken line at 25, to the outlet pipe dimensions.

In FIG. 4 a separate shunt chamber 26 is shown as a cylindrical annulus surrounding the fluid flow pipe 27, which is shown enlarged at 28. The chamber 26 is shown with terminating annuli 29 and 30 of energy absorbing material. Coupling holes 31 between pipe 28 and chamber 26 are provided. In the case of an exhaust gas silencer the holes 31 communicate directly between pipe 28 and chamber 26 but for hydraulic or similar systems the holes 31 are covered by an elastic sealing membrane and the chamber 26 is gas-filled, preferably air filled.

FIG. 5 shows a modification of FIG. 4 which particular fits it as a silencer for an internal combustion engine. A venturi reduction 32 is placed in the exhaust flow pipe 33 and coupling holes 34 and 35 are provided circumferentially adjacent each end of the shunt chamber 36 having terminating pads 37 and 38. The venturi reduction 32 provides increased coupling into the shunt chamber. The venturi reduction 32 may be replaced by an orifice plate.

For silencing jet engines efflux the arrangement of FIG. 4 may be used or a series of cylindrical silencing chambers may be grouped round the jet pipe in a multilobed arrangement. In the latter case, coupling may be alternatively through a series of communicating pipes of a length to give maximum sound energy transfer at a desired engine noise frequency, e.g. corresponding to take-off speed.

The Industrial Applicability of the Invention lies in all fields of silencers. In every case the absence of pressure drop across the silencer and its constant high efficiency maintained over the whole range of noise frequencies are of outstanding practical importance.

These and other practical advantages will be illustrated by the automobile case where development testing has been carried out with three vehicles fitted with silencers according to the Invention. Corresponding results have been obtained with a silencer according to the Invention fitted to a small two-stroke petrol engine.

The features of the Invention demonstrated by the automobile case can be summarized as follows:

(1) The constant high silencing efficiency obtained with the aperiodic terminations is maintained with full variation of speed and different vehicle engines.

(2) The virtually zero pressure drop across the silencer leads to a number of advantages.

First of all, this substantially eliminates the loss of power due directly to this effect with conventional silencers.

Secondly because of the absence of back pressure with the silencer according to the Invention, the engine runs at a lower working temperature. This is important, not only from the mechanical point of view in avoiding physical distortion leading to wear and loss of power, but also with the electronic equipment fitted to modern engines, the low temperature environment in the engine compartment greatly improves reliability. Extremely high temperatures can lead to complete breakdown.

Finally, and highly significant in the context of the aims of the Invention, the virtual elimination of residual exhaust gases means that combustion is complete, the mixture is free of diluting impurities; and apart from increased power being developed, the fully burnt gas from the exhaust is reduced in pollution emission.

What is claimed is:

1. A silencer device comprising an elongate chamber having two ends and generally defining a straight-line transmission path, said transmission path leading generally from one end of the chamber to the other, and being substantially uninterrupted by physical obstruction, the chamber being provided adjacent said ends with inlet and outlet apertures defining paths of entry to and exit from the chamber and communicating with the transmission path to provide a through-going transmission path, the chamber being principally occupied by a fluid having a predetermined characteristic impedance and being provided, at said ends, with acoustic energy absorbing means for providing energy dissipating acoustic impedance type terminations to said chamber, the acoustic impedance of the said terminations being substantially equal to the characteristic impedance of the fluid in the chamber.

2. A silencer as claimed in claim 1, wherein the terminations comprise a filament which is knitted, woven or crumpled together to form acoustic energy absorbing pads.

3. A silencer as claimed in claim 1, wherein the terminations comprise a metallic filament which is knitted, woven or crumpled together to form acoustic energy absorbing pads.

4. A silencer as claimed in claims 2 or 3, wherein the chamber is substantially cylindrical and is provided at each end with one or more acoustic energy absorbing pads, and where the paths of entry to, or exit from the chamber are substantially perpendicular to the straight-line transmission path of the fluid to be silenced.

5. A silencer as claimed in claim 4, wherein one end of the chamber is tapered towards one of the acoustic energy absorbing pads.

6. A silencer as claimed in claim 4, wherein the acoustic energy absorbing pads are convexly shaped.

7. A silencer as claimed in claim 4, wherein acoustic energy absorbing pads are further provided on an internal surface of said chamber facing said inlet and outlet apertures of said chamber.

8. A silencer as claimed in claim 1, wherein the chamber includes small raised formations on an internal surface thereof to give a combination of break-up and lossy action on sound patterns.

9. A silencer as claimed in claim 8, wherein the small formations are provided by a helix of increasing pitch lying against the internal surface of the chamber.

10. A silencer as claimed in claim 1, wherein the terminations comprise a screen-folded gauze or mesh to provide said acoustic energy absorbing means.

11. A silencer device comprising a transmission pipe having an inlet end and an outlet end generally defining a through-going transmission path for fluid to be silenced, the transmission pipe being surrounded by an annulus comprising an elongate shunt chamber, the chamber and the transmission pipe being acoustically coupled by apertures in the transmission pipe, the chamber being principally occupied by a fluid having a predetermined characteristic impedance and being provided at both ends thereof with acoustic energy absorbing means for providing energy dissipating acoustic impedance type terminations to said chamber, the acoustic impedance of the terminations being substantially equal to the characteristic impedance of the fluid in the chamber.

12. A silencer as claimed in claim 11, wherein the terminations comprise a filament which is knitted, woven or crumpled together to form acoustic energy absorbing pads.

13. A silencer as claimed in claim 11, wherein the terminations comprise a metallic filament which is knitted, woven or crumpled together to form acoustic energy absorbing pads.

14. A silencer as claimed in claim 11, wherein the terminations comprise a screen-folded metallic gauze or mesh to provide said acoustic energy absorbing means.

15. A silencer as claimed in claims 12 or 13, wherein the chamber is substantially cylindrical and is provided at each end with one or more acoustic energy absorbing pads.

16. A silencer as claimed in claim 15, wherein one end of the chamber is tapered towards one of the acoustic energy absorbing pads.

17. A silencer as claimed in claim 15, wherein the acoustic energy absorbing pads are convexly shaped.

18. A silencer as claimed in claim 11, wherein a venturi reduction is included in the transmission pipe to increase the acoustic coupling to the chamber.

* * * * *